US006651372B2

(12) United States Patent
Del Fatti

(10) Patent No.: US 6,651,372 B2
(45) Date of Patent: Nov. 25, 2003

(54) FULL-MOON CLIP CARRIER

(76) Inventor: Mathew Del Fatti, 907 S. Main St., Greenwood, WI (US) 54437

( * ) Notice: Subject to any disclaimer, the term of this patent is extended or adjusted under 35 U.S.C. 154(b) by 0 days.

(21) Appl. No.: 10/113,032

(22) Filed: Apr. 1, 2002

(65) Prior Publication Data

US 2002/0144448 A1 Oct. 10, 2002

Related U.S. Application Data

(60) Provisional application No. 60/281,359, filed on Apr. 4, 2001.

(51) Int. Cl.[7] ..... F42B 39/00; F41A 9/61; F41A 9/82

(52) U.S. Cl. ..... 42/89; 224/239; 224/931

(58) Field of Search ..... 42/89, 88; 224/663, 224/239, 931

(56) References Cited

U.S. PATENT DOCUMENTS

| | | | | |
|---|---|---|---|---|
| 3,150,459 A | | 9/1964 | Van Schoick | |
| 3,769,732 A | | 11/1973 | Griffis | |
| 3,769,733 A | | 11/1973 | Nelson | |
| 4,272,903 A | | 6/1981 | Griffis | |
| 4,408,707 A | * | 10/1983 | Rogers | 224/239 |
| 4,697,368 A | * | 10/1987 | Williams | 42/71.02 |
| 5,174,482 A | | 12/1992 | Rogers et al. | |
| 5,953,845 A | * | 9/1999 | Longwitz | 42/89 |

* cited by examiner

*Primary Examiner*—Charles T. Jordan
*Assistant Examiner*—John W. Zerr
(74) *Attorney, Agent, or Firm*—Thompson Hine LLP

(57) ABSTRACT

A firearm accessory holder which facilitates the secure carry and rapid deployment of a loaded full-moon clip when being worn on the waist belt. The carrier mounts to the wearer's waist belt by means of a belt loop. It secures the loaded full-moon clip by means of a wearer adjustable central compression expansion shaft in combination with a snap secured leather flap cover.

20 Claims, 3 Drawing Sheets

FULL-MOON CLIP CARRIER

CROSS-REFERENCE TO RELATED APPLICATIONS

This application claims the benefit of U.S. Provisional Application No. 60/281,359, filed Apr. 4, 2001.

TECHNICAL FIELD

The present invention relates generally to firearm accessory holders and, more particularly, to ammunition clip holders that are worn on a waist belt.

BACKGROUND

Persons authorized to carry handguns commonly carry extra ammunition in a readily accessible carrier or pouch on their waist belt. For many years, holster makers have devised and manufactured many types of ammunition carriers for this purpose. Some of these items include pistol magazine carriers, revolver ammunition dump pouches, and what are commonly known as speed loader carriers.

Pistol magazines allow individual cartridges to be contained as a unit for rapid loading. Revolver users are afforded a similar convenience by grouping individual cartridges for their handguns into devices such as full-moon clips and various speed loading devices. The full-moon clip used by some revolvers is a circular shaped flat spring steel device with notches in its outer circumference, which accept and hold from five (5) to eight (8) cartridges in a circular pattern so they can easily be loaded simultaneously into the open cylinder of a revolver.

While revolvers designed to use full-moon clips have become more popular for competition and concealed carry by law enforcement officers and others who are legally authorized to do so, little attention has been given to design a full-moon clip carrier. Specifically, there is a need for a full-moon clip carrier, which simultaneously allows for secure carry and rapid access to the ammunition.

SUMMARY

A carrier for carrying a spare ammunition clip on a waist belt is provided including a carrier body that may be folded back on itself to encircle the spare ammunition clip, a belt loop to secure the carrier to a waist belt, a central shaft for securing the spare ammunition clip within the carrier, and at least one snap or other fastener such as a hook and loop system (e.g. the VELCRO™ system) for closing the carrier body around the spare ammunition clip. The carrier body and belt loop may be made of leather or another material normally used in the manufacture of handgun holsters and accessories. The central shaft may be made from rubber washers or other elastic material so that a diameter of the shaft can be adjusted by turning a retention screw.

DETAILED DESCRIPTION

An ammunition clip carrier 20 is provided which allows a wearer to conveniently and securely carry a spare ammunition clip 8 for a revolver on a waist belt. In a first aspect, a loaded full-moon clip may be carried. In another aspect, a device commonly known as a speed loader may be carried simply by altering the dimensions of the component parts of the carrier 20.

Figure 1:
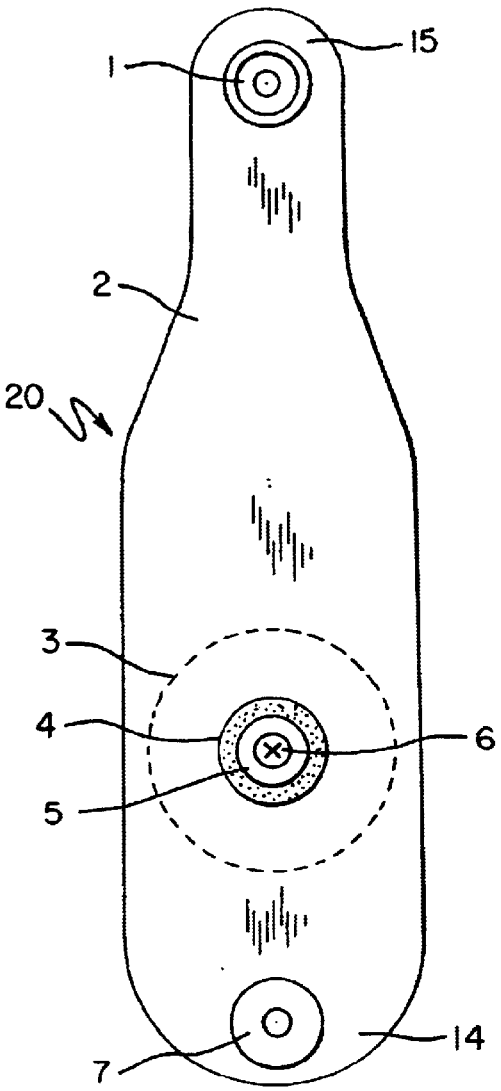
FIG. 1 is an open frontal view of a carrier according to one aspect.
Figure 2:
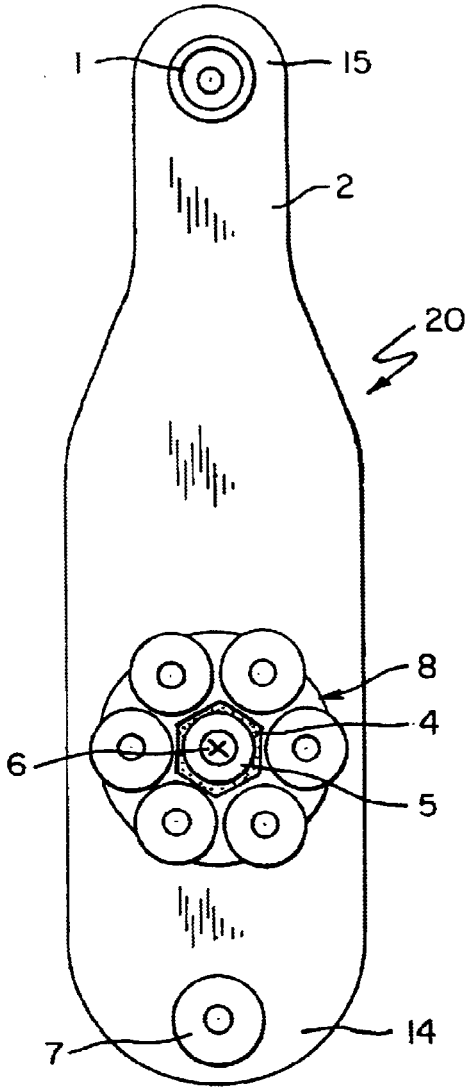
FIG. 2 is an open frontal view of the carrier of FIG. 1 with a loaded ammunition clip positioned on the center shaft.
Figure 3:
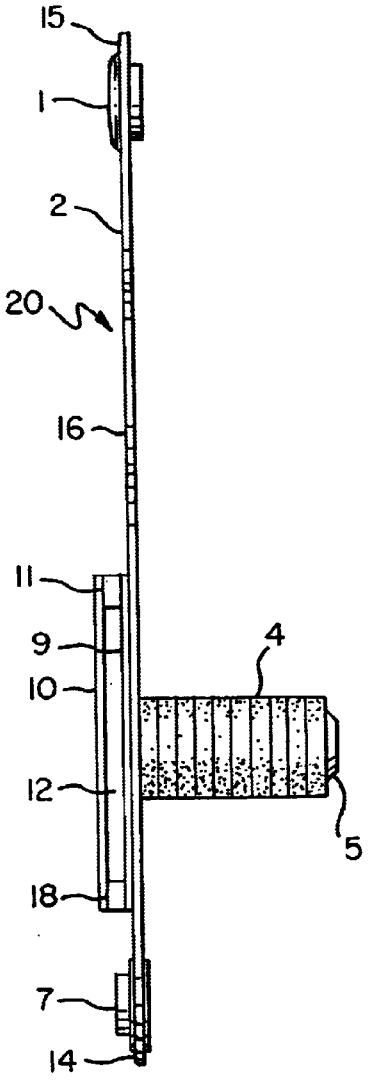
FIG. 3 is an open side view of the carrier of FIG. 1.
Figure 6:
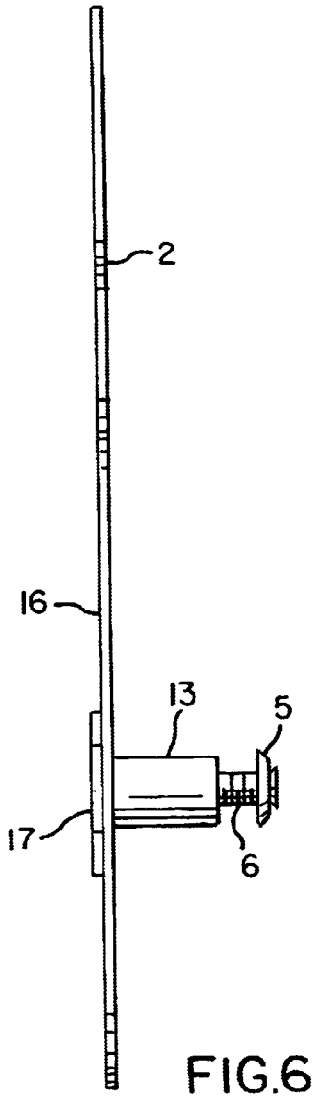
FIG. 6 is an open side view of the carrier in a partially assembled state.
Figure 7:
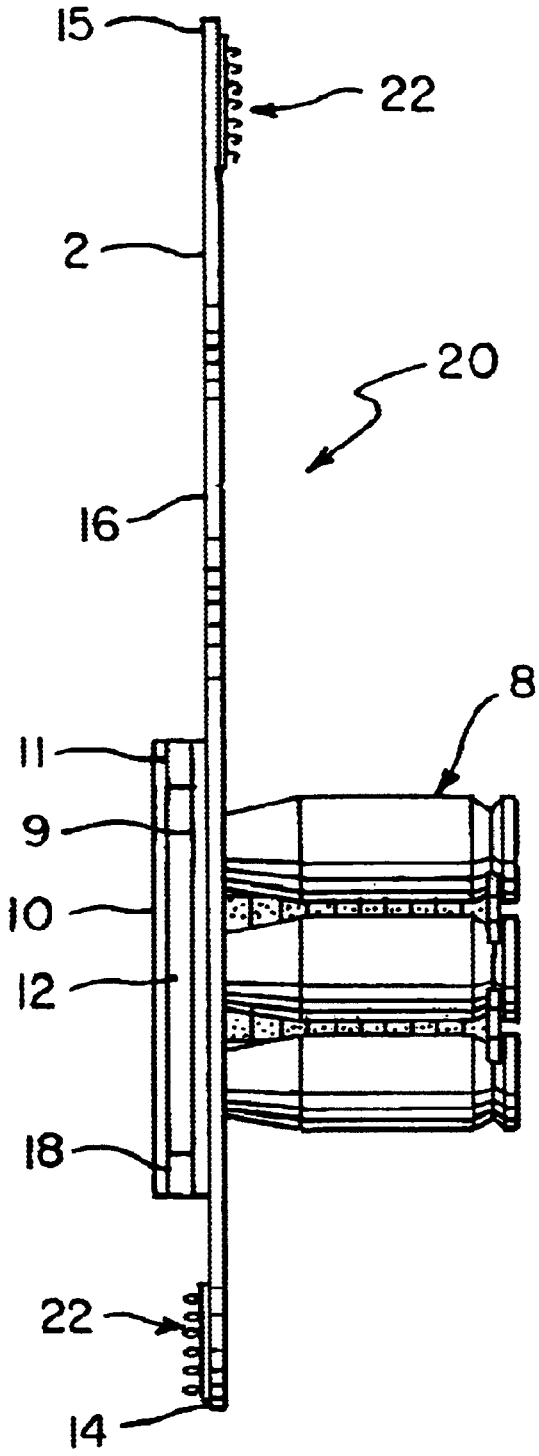
FIG. 7 is an open side view of a carrier according to a second aspect having a hook and loon system.

Referring to FIG. 1, the carrier 20 may include a carrier body 2, which may be cut from a single piece of leather or another material that is normally used in the manufacture of handgun holsters and accessories. In other embodiments, the carrier body 2 may be formed from more than one piece. The carrier body 2 may include a snap set having a male member 7 and a female member 1 attached at a first end 14 and a second end 15 of the carrier body 2 respectively. In another embodiment, shown in FIG. 7. the carrier body may include a hook and loop fastener system 22 in place of the snap set. Referring to FIGS. 3 and 6, a shaft 4 may be attached to the carrier body 2 by means of a t-nut 13, a retention washer 5 and a screw 6. As shown in FIGS. 1 and 2, the shaft 4 may be located on the vertical midline of the carrier body 2 in the lower half of the carrier body 2. The t-nut 13 may be partially inserted through the carrier body 2 from a rear side 16 of the carrier body 2 before a belt loop 12 is attached to the rear side 16 of the carrier body 2. Once the belt loop 12 is attached to the carrier body 2, a base 17 of the t-nut 13 may be hidden between the carrier body 2 and the belt loop 12. The belt loop 12 may be glued and stitched to the carrier body 2. Referring to FIG. 1, a stitch 3 is shown which may attach the carrier body 2 to the belt loop 12.

When the carrier is worn, the shaft 4 may be perpendicular to an outer surface of a wearer's belt. Referring to FIG. 3, the shaft 4 may be formed from rubber washers mounted on the t-nut 13. The rubber washers which may make up the shaft 4 may be held in place by a retention washer 5 and a screw 6. This configuration also allows the wearer to adjust a diameter of the shaft 4 by tightening or loosening the screw 6 thereby adjusting the amount of normal force exerted by the shaft 4 on an ammunition clip 8. As the screw 6 is tightened, the length of the shaft body 4 is decreased causing the diameter of the compressed rubber washers to increase. In other embodiments, a different elastic material may be substituted for the rubber washers.

In operation, a spare ammunition clip 8 may be retained within the carrier 20 through the use of friction between the shaft 4 and the ammunition 8 that is being held. A spare ammunition clip 8 may be positioned over the shaft 4. The diameter of the shaft 4 may be adjusted by turning the screw 6 in the shaft 4, thereby adjusting the friction force between the central shaft 4 and ammunition being held. Furthermore, the carrier body 2 may be folded over the ammunition clip 8 so as to encircle it. The carrier body 2 can then be held closed around the ammunition clip 8 by a snap 1, 7 or other fastener to permit quick access to the ammunition.

Figure 5:
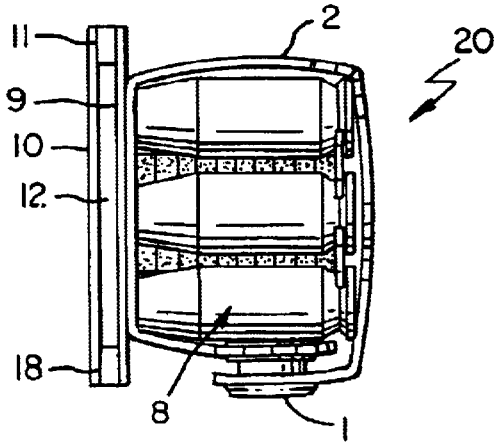
FIG. 5 is a closed side view of the carrier of FIG. 4.
Figure 4:
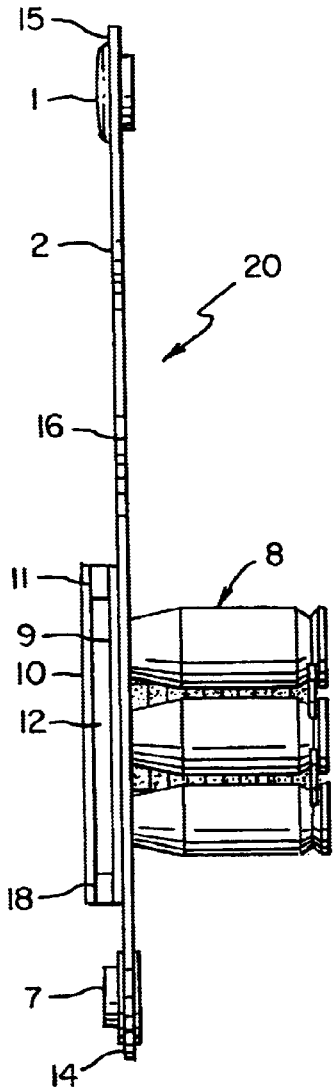
FIG. 4 is an open side view of the carrier of FIG. 2.

Referring to FIGS. 3–5, the belt loop 12 may be formed from two pieces, the belt loop front 9 and the belt loop back 10, which are stitched together at their top and bottom to form a top welt 11 and a bottom welt 18. In another embodiment the belt loop may be formed from a single folded piece of material which may be either stitched or riveted to form the belt loop 12. Like the carrier body 2, the belt loop 12 may be formed from leather or another material that is commonly used in the manufacture of handgun holsters and accessories.

Referring to FIG. 5, an ammunition clip 8 is shown mounted on the shaft 4. The carrier body 2 has been folded back on itself and the male snap member 7 and female snap member 1 are engaged so as to close the carrier body 2 over clip 8. The sides of the ammunition clip 8 may be left exposed to allow the wearer to grip these points with his or her middle finger before disengaging the female snap member 1 from male snap member 7 with his or her index finger. The ammunition clip 8 can then be freely withdrawn from the carrier and inserted into an empty revolver cylinder.

What is claimed is:

1. A carrier for carrying an ammunition clip, the carrier comprising:

a carrier body having a first portion and a second portion, the first portion movable between an open position and a closed position;

a shaft to said carrier body for retaining the ammunition clip, the shaft having an adjustable diameter and a means for adjusting said diameter; and a fastener for attaching the first portion of the carrier body to the second portion of the carrier body when the first portion is in the closed position.

2. The carrier of claim 1 wherein the carrier body encircles an ammunition clip retained on the shaft when the first portion of the carrier body is in the closed position.

3. The carrier of claim 1 wherein the shaft is generally sized to be received in a central opening of the ammunition clip.

4. The carrier of claim 3 wherein a diameter of the shaft is slightly larger than a diameter of the central opening of the ammunition clip.

5. The carrier of claim 4 wherein the ammunition clip is retained on the shaft by positioning the ammunition clip onto the shaft so that the shaft is snuggly received in the central opening of the ammunition clip.

6. The carrier of claim 1 wherein the shaft includes a non-rigid outer surface.

7. The carrier of claim 6 wherein the non-rigid outer surface is made of at least one annular rubber member.

8. The carrier of claim 1 wherein a length of the shaft is adjustable.

9. The carrier of claim 8 wherein the diameter of the shaft is adjusted by adjusting the length of the shaft.

10. The carrier of claim 9 wherein an outer surface of the shaft comprises a compressible annular member.

11. The carrier of claim 10 wherein said fastener is a snap.

12. The carrier of claim 10 wherein said fastener is a hook and loop system.

13. The carrier of claim 3 wherein the ammunition clip is a loaded full-moon clip.

14. The carrier of claim 1 further comprising a belt loop attached to the carrier body.

15. A carrier for carrying an ammunition clip, the carrier comprising:

a carrier body having a first portion and a second portion, the first portion movable between an open position and a closed position;

a shaft extending from said carrier body for retaining the ammunition clip thereon when the shaft is received in an opening of the ammunition clip, the shaft having an adjustable length and an adjustable diameter, and a means for adjusting said length and said diameter wherein a user may increase a friction force between the shaft and the ammunition clip by reducing the length of the shaft to thereby increase the diameter of the shaft; and a fastener for attaching the first portion of the carrier body to the second portion of the carrier body when the first portion is in the closed position.

16. The carrier of claim 15, wherein the outside diameter of the shaft is slightly larger than the diameter of the opening of the ammunition clip.

17. The carrier of claim 15, wherein the friction force between the shaft and the ammunition clip can be adjusted by the user while the shaft is received in the opening of the ammunition clip.

18. The carrier of claim 15, wherein the diameter of the shaft can be adjusted by the user before the shaft is received in the opening of the ammunition clip.

19. The carrier of claim 15, wherein the user may decrease the friction force between the a shaft and the ammunition clip by increasing the length of the shaft to thereby decrease the diameter of the shaft.

20. A carrier for carrying an ammunition clip, the carrier comprising:

a carrier body having a first portion and a second portion, the first portion movable between an open position and a closed position;

a shaft attached to the carrier body for retaining the ammunition clip when the shaft is received into a central opening of the ammunition clip, the shaft comprising a t-nut received through an aperture in the carrier body, a screw in threaded engagement with the t-nut, and a compressible annular member retained between distal ends of the engaged t-nut and screw, wherein the diameter of the annular member can be increased by turning the screw to compress the annular member between the distal ends of the engaged t-nut and screw; and a fastener for attaching the first portion of the carrier body to the second portion of the carrier body when the first portion is in the closed position.

* * * * *

UNITED STATES PATENT AND TRADEMARK OFFICE

CERTIFICATE OF CORRECTION

PATENT NO. : 6,651,372 B2
DATED : November 25, 2003
INVENTOR(S) : Mathew Del Fatti It is certified that error appears in the above-identified patent and that said Letters Patent is hereby corrected as shown below:

Column 3,
Line 15, after the word “shaft” insert -- attached --;

Column 4,
Line 29, Delete “a” before “shaft”.

Signed and Sealed this

Ninth Day of March, 2004

JON W. DUDAS
*Acting Director of the United States Patent and Trademark Office*